United States Patent [19]

Davis

[11] 4,112,299

[45] Sep. 5, 1978

[54] CORONA DEVICE WITH SEGMENTED SHIELD

[75] Inventor: Thomas G. Davis, Pittsford, N.Y.

[73] Assignee: Xerox Corporation, Stamford, Conn.

[21] Appl. No.: 818,782

[22] Filed: Jul. 25, 1977

Related U.S. Application Data

[63] Continuation of Ser. No. 710,525, Aug. 2, 1976, abandoned, which is a continuation of Ser. No. 553,339, Feb. 26, 1975, abandoned.

[51] Int. Cl.[2] ..... G03G 15/00; G03G 15/02

[52] U.S. Cl. ..... 250/326; 361/225

[58] Field of Search ..... 250/324, 325, 326; 317/262 A; 355/3 TR; 361/225

[56] References Cited

U.S. PATENT DOCUMENTS

| | | | |
|---|---|---|---|
| 3,754,137 | 8/1973 | Kamogawa et al. | 250/326 |
| 3,789,278 | 1/1974 | Bingham et al. | 250/326 |

FOREIGN PATENT DOCUMENTS

| | | | |
|---|---|---|---|
| 1,270,273 | 4/1972 | United Kingdom | 250/326 |

*Primary Examiner*—Alfred E. Smith
*Assistant Examiner*—T. N. Grigsby

[57] ABSTRACT

A corona charging device comprising an elongated wire electrode and a shield partially surrounding the electrode, the shield being formed of a plurality of conducting segments insulated from each other and biased to a plurality of different potentials relative to the wire. The distribution of charge from the corona device onto an adjacent surface may be controlled by changing the biasing arrangement on the shield segments.

6 Claims, 3 Drawing Figures

CORONA DEVICE WITH SEGMENTED SHIELD

This is a continuation of application Ser. No. 710,525, filed Aug. 2, 1976, now abandoned which was a continuation of Ser. No. 553,339 filed Feb. 26, 1975, now abandoned.

BACKGROUND OF THE INVENTION

This invention relates to a novel corona discharge device for depositing charge on an adjacent surface in a controlled pattern and has particular utility in the art of xerography.

Corona discharge devices play an important role in the practice of xerography by establishing or altering the electrostatic charge on adjacent surfaces at several different times during the xerographic cycle. For example, corona devices are generally employed to lay down an initial uniform charge on a photoreceptor, which charge is dissipated in part by exposure to an optical image to form an electrostatic latent image.

After development of the latent image with toner particles, corona devices may also be utilized to alter the charge on the deposited toner prior to transfer of these particles to a copy sheet in order to enhance image transfer and limit background transfer.

Corona devices may further be used to deposit charge on the surface of a copy sheet in order to cause transfer and adherence of toner thereto. In addition, corona devices aid in the stripping or detacking of copy sheets from a photoconductive drum and in neutralizing electrostatic charges on the photoconductor surface prior to the initiation of a new copy cycle.

Conventional forms of corona generating apparatus are illustrated in U.S. Pat. Nos. 2,836,725 and 2,879,395 and generally comprise one or more wire-like electrodes, known as coronodes, horizontally disposed above the surface to be charged and a shield which may take a plurality of different structural forms, partially disposed about the coronode. In one conventional mode of operation, a high voltage D.C. power supply is connected to the coronode with the requisite polarity for the charging operation which is desired, while a conductive layer associated with the surface to be charged is grounded as are the other terminals of the power supply in the shield.

In an alternate mode of conventional corona generating apparatus operation, a D.C. power supply is connected to the coronode and a conductive layer associated with the surface to be charged while the shield is left unconnected or electrically open.

Another arrangement for biasing a corona discharge device in a xerographic machine is taught in U.S. Pat. No. 2,868,989, wherein the corona wire is biased to a high positive corona generating potential, the conductive substrate on which the photoconductive material is held is maintained at ground potential, and the shield is biased to a potential intermediate the corona wire potential and ground.

It should be noted that in each of the above biasing arrangements, the shield is formed of a single integral conducting member which is biased to a constant potential or left unbiased.

Such arrangements have the disadvantage of being static or constant in the charge distributed thereby to an adjacent surface. In some instances, however, it is desirable to charge the distribution of charge delivered to the surface to be charged to create specific charge distribution patterns and to be able to alter these patterns in accordance with the demands of the particular xerographic processor in which the corona devices are used.

Several prior art arrangements for obtaining non-uniform charge distribution are disclosed in U.S. Pat. No. 3,160,746.

OBJECT & SUMMARY

An object of the invention is to provide a novel arrangement for controlling the distribution of charge from a corona discharge device onto a surface to be charged.

These and other objects are realized by a corona charging device comprising an elongated wire and a shield partially surrounding the wire. The shield is formed of a plurality of conducting segments insulated from each other and biased to a plurality of different potentials relative to the wire. The charge pattern deposited on an adjacent surface may be controlled by changing the bias potentials on the shield segments.

DESCRIPTION OF THE PREFERRED EMBODIMENT

Figure 1:
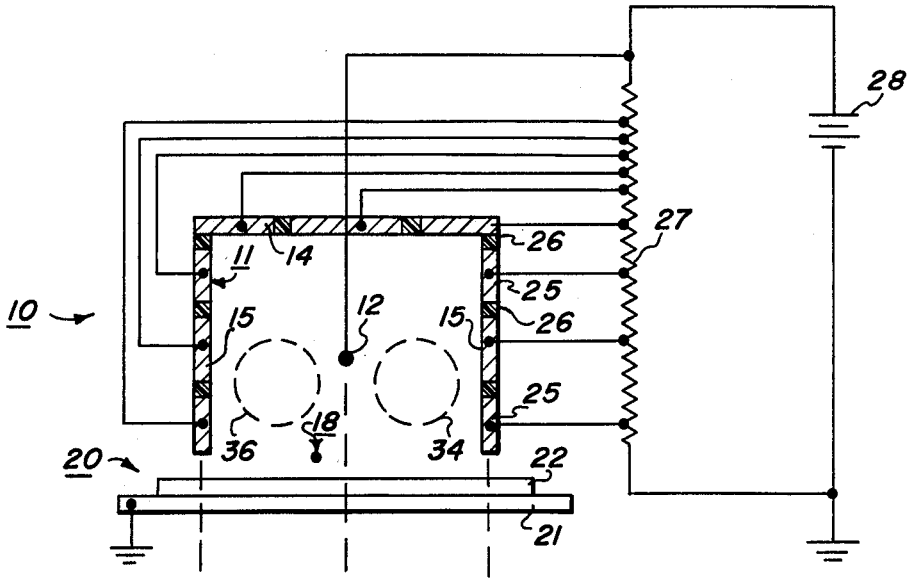
FIG. 1 is an enlarged section along line 1—1 of FIG. 3.
Figure 3:
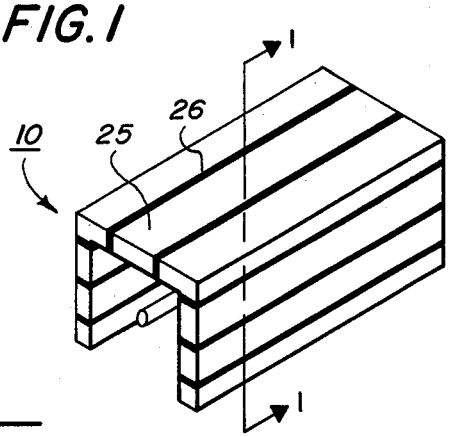
FIG. 3 is a perspective view of the corona device of the invention.

Referring to FIGS. 1 and 3, there is illustrated a corona discharge device generally designated 10 comprising a conductive shield 11 partially surrounding a corona wire or coronode 12. It should be understood that a plurality of coronodes may be used instead of the one shown in FIG. 1. The shield 11 may, if desired, have an upper or a backing wall 14 and side walls 15 and an ion exit opening 18. Desirably, the ion slit extends substantially completely along the length of the electrode 12 across the bottom face and may be fixed or adjustable as desired. The corona wire or coronode 12 is mounted more or less centrally within the shield and electrically insulated from the shield, for example, by insulating end walls or mounting blocks 19 and spaced sufficiently from the surfaces of the shield so as to eliminate sparking between the wires and the shield.

The general construction and operation of a corona device as discussed above is well known in the prior art. The particular shape or configuration of the shield is but one of many acceptable shield configurations known in the xerography art, any of which are usable in the invention and described in detail in U.S. Pat. No. 2,879,395 and 2,836,725. The corona discharge device 10 is illustrated as being positioned above and closely adjacent to the surface to be charged such as, for example, a xerographic plate generally designated 20 comprising a conductive support base 21 having on its surface an insulating or photoconductive insulating layer 22. Preferably, the surface 20 is movable relative to the corona discharge device by suitable drive means which may take various forms. One conventional arrangement for moving the photoconductive surface is to construct the surface and support base in the form of a drum with means provided for rotating the drum below the corona discharge device. The motion of the photoconductive surface is generally across the direction of the ion slit 18.

As is understood in the prior art, corona discharge is a breakdown of gas in the region of a very strong electric field such as the electric field at the surface of a conductor having a small radius of curvature. In the case of a given corona discharge device of the type shown in FIG. 1, the strength of the electric field at the coronode is a function of the potential difference between it and adjacent surfaces and the distance to these surfaces. For a given geometry there is a very definite starting potential difference below which essentially no current flows and above which the corona is self-maintaining and the gas surrounding the wire is ionized. Corona current flows by means of these ionized gas molecules or ions and the electrons they release.

In the arrangement of the FIG. 1, the electric field at the wire coronode is affected by the potential difference between the wire and the shield, and the wire and the photoconductive surface. If the potential on the shield is held constant the electric field between it and the wire is also constant during the charging process. In contrast to this, the potential of the photoconductor surface increases during the charging process as charges are deposited thereon, thus reducing the electric field between the photoconductor and the wire. Although ion generation is fostered primarily by a large potential difference between the shield and the wire, it should be noted that this potential difference is limited by the fact that unduly large potentials will cause a spark to bridge these surfaces.

Ions generated by the above process move or migrate from the area adjacent the corona electrode toward adjacent surfaces also as a function of the electric field therebetween. Thus, the same relatively high field between the wire and the shield which produced the ions now causes movement of a substantial majority of these ions to the shield, while a much lesser percentage of the ions flow to the photoconductor surface.

Referring to FIG. 1, the shield of the corona device of the invention is constructed of a plurality of conducting segments 25 insulated from each other by insulator members 26. Each of the conductive sections is connected to a different tap on the resistor 27, the resistor 27 being connected in series across a battery or other suitable source 28. Thus, each of the conductive shield sections 25 is held at a different potential with respect to the wire which is connected to the positive high voltage side of the battery.

Figure 2:
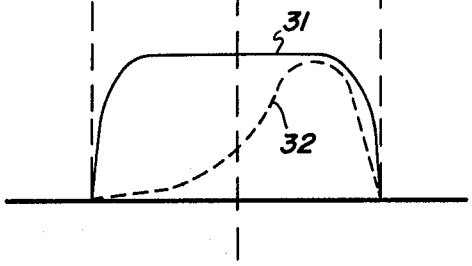
FIG. 2 is a graphical comparison of charge distributions.

Referring to FIG. 2, the charge distribution on the surface of a stationary photoconductor from a prior art corona discharge device having a uniform potential applied to the shield is shown as curve 31. The distribution of charge from such a prior art device on the stationary photoconductor tends to be uniform across the surface thereof or at least symmetrical with respect to the midpoint of its exposed surface. This results from the fact that the electric fields generated between the wire and shield are generally symmetrical with respect to the wire. The symmetrical fields in turn result from the uniform biasing of the shield. However, the symmetrical nature of the fields and resulting charge patterns in the prior art may also result from arrangements in which different potentials were applied to a plurality of shield segments, but where such potentials were symmetrically distributed with respect to the wire. It should be noted that the ideal distribution shown in FIG. 2 are not achieved in practice due to various factors well known to those skilled in the art and are being used herein only as an aid in explaining the operation of the invention.

The charge distribution resulting from the specific biasing arrangement of the invention shown in FIG. 1 is illustrated generally in FIG. 2 as curve 32. It is noted that since the right-hand most conductive segments 25 of the shield arrangement of FIG. 1 are biased to a low potential relative to the wire, a large potential difference exists therebetween which in turn results in a high ion density in the region generally designated as 34. Such a relatively high concentration of ions in region 34 leads to a large charge density in right-hand portion of surface 22 as illustrated in curve 32.

As opposed to this, conductive segments 25 located on the left side of the shield (as seen in FIG. 1) are held at potentials relatively closer to the potential of the wire. Thus, a lower electric field intensity is associated with the region 36 and consequently less ions are generated therein. Since a relatively small ion density exists in region 36, less ions find their way to the photosensitive surface directly below region 36 resulting in a smaller charge on this portion of the photoconductive surface 22. In summary, by biasing adjacent segments of the shield to different potentials with respect to the wire and more particularly to biasing the shield segments non-symmetrically with respect to the wire, ion densities in the areas adjacent the corona wire are made non-symmetrical, resulting in a non-uniform charge distribution across the adjacent surface to be charged.

Looked at from another point of view, the corona discharge device of the invention provides a means for emulating the corona charging characteristics of a variety of specific corona devices with a single structure by simply varying the potentials applied to the corona shield sections. Thus, the invention has the capability of performing the role of a universal corona device adaptable to a variety of situations. Thus, where the past ion density patterns were altered by changes in the shape of the shield or spacings to the corona wire, these same patterns may now be attained by altering the potentials applied to the various shield segments.

What is claimed is:

1. A corona device for charging a surface comprising an elongated wire, means for applying a corona generating potential to said wire, and a shield disposed on the side of said wire opposite said surface, said shield being formed of a plurality of conductive segments insulated from each other and biased to different potentials with respect to said wire, each of said conductive segments located with respect to said wire to substantially effect the density of charge in areas intermediate said wire and said segments as a function of the potential on said segment.

2. The combination recited in claim 1 wherein said shield is generally U-shaped in cross section, and said segments comprise rectangular members running substantially the entire length of said device.

3. The combination recited in claim 1 wherein said shield is generally U-shaped in cross section and said sections comprise generally rectangular members running substantially the entire length of said device.

4. The method of varying the density of charge delivered to an elongated electrode to an adjacent surface along a plane parallel to said surface comprising the steps of:

providing a plurality of conductive segments running generally parallel to said electrode on the side of said electrode opposite said surface; and applying different potentials of sufficient magnitude to said segments to effect a greater than negligible change in the density distribution of charge flow to discrete areas of said surface by varying the strength of the electric field at adjacent surface areas of said electrode.

5. The method of claim 4 further including the step of changing said potentials to affect a different density distribution as a function of the magnitude of the change in potentials.

6. A corona device for depositing charge on an adjacent surface comprising:

an elongated corona electrode spaced from said surface;

a shield adjacent said electrode and having a plurality of conductive sections running generally parallel to and spaced from said electrode on the side of said electrode remote from said surface; said sections cooperating with said wire to provide electric fields adapted to alter the charge output of said device in a non-negligible manner; and means for establishing different potential differences between said wire and said sections, said potential differences being of sufficient magnitude to control the flow of charge to said surface in planes generally perpendicular to said wire and said surface.

* * * * *